US006679405B2

(12) United States Patent
Zalis-Hecker et al.

(10) Patent No.: US 6,679,405 B2
(45) Date of Patent: Jan. 20, 2004

(54) SHOE THING

(76) Inventors: Kara Sue Zalis-Hecker, 3 N. Columbus Blvd., #249, Philadelphia, PA (US) 19106; Marlene Present, 119 N. Van Pelt St., Philadelphia, PA (US) 19103

( * ) Notice: Subject to any disclaimer, the term of this patent is extended or adjusted under 35 U.S.C. 154(b) by 230 days.

(21) Appl. No.: 09/873,989

(22) Filed: Jun. 4, 2001

(65) Prior Publication Data

US 2002/0179658 A1 Dec. 5, 2002

(51) Int. Cl.[7] ..... A45F 5/00

(52) U.S. Cl. ..... 224/267; 150/107; 224/270; 224/578; 224/660; 224/674; 224/675

(58) Field of Search ..... 224/267, 222, 224/660, 219, 663, 674, 675, 578; 150/102, 107; D3/226, 247, 249, 250, 251, 252, 253

(56) References Cited

U.S. PATENT DOCUMENTS

| | | | | | |
|---|---|---|---|---|---|
| 1,983,847 | A | * | 12/1934 | Gardner | 150/143 |
| D104,171 | S | * | 4/1937 | Morris | D3/251 |
| D137,727 | S | * | 4/1944 | Berens | D3/253 |
| D141,316 | S | * | 5/1945 | Smallman | D3/251 |
| 2,651,346 | A | * | 9/1953 | Nash | 150/143 |
| 3,199,754 | A | * | 8/1965 | Sorensen | 224/222 |
| 4,332,338 | A | * | 6/1982 | Christiansen | 150/143 |
| 4,570,688 | A | * | 2/1986 | Williams | 150/102 |
| 4,763,821 | A | * | 8/1988 | Powell | 224/222 |
| 4,801,059 | A | * | 1/1989 | Hayes | 224/240 |
| 4,998,653 | A | * | 3/1991 | LaBelle | 224/578 |
| 5,070,581 | A | * | 12/1991 | Senter | 24/3.5 |
| 5,285,833 | A | * | 2/1994 | Haxby | 150/102 |
| 5,409,153 | A | * | 4/1995 | Ristich | 224/661 |
| D358,478 | S | * | 5/1995 | Bluestein | D3/251 |
| 5,423,363 | A | * | 6/1995 | Matzdorff et al. | 150/143 |
| 5,526,924 | A | * | 6/1996 | Klutznick | 206/5 |
| 5,577,652 | A | * | 11/1996 | Cooper | 224/578 |
| 5,586,707 | A | * | 12/1996 | Haskell | 224/242 |
| D380,606 | S | * | 7/1997 | Chen | D3/226 |
| D382,706 | S | * | 8/1997 | Sligh | D3/232 |
| D426,703 | S | * | 6/2000 | Kojoori | D3/249 |
| 6,112,961 | A | * | 9/2000 | Phillips | 150/131 |
| D433,801 | S | * | 11/2000 | Shreve | D3/226 |
| D435,170 | S | * | 12/2000 | Haapala | D3/252 |
| 6,220,493 | B1 | * | 4/2001 | Iijima et al. | 224/578 |

* cited by examiner

*Primary Examiner*—Gregory Vidovich
*Assistant Examiner*—Maerena W. Brevard
(74) *Attorney, Agent, or Firm*—Stuart N. Hecker

(57) ABSTRACT

A multi-functional small pouch accessory that is made of a variety of materials and has easy access to storage for keys, money, identification, etc. The pouch is compact and easy to use with its adjustability and slide-ability. The pouch has ornamentation and comes in a variety of colors and fun shapes. The pouch folds in half creating two storage pockets and has a separate third clear-windowed identification pocket visible only when in the open position. The pouch has a small hook and loop closure to secure in the closed position but still allows for quick and easy access. The pouch easily attaches and detaches to a shoelace, boot, ankle, any body part or pet with or without a separate adjustable strap, rope or chain. Two elastic loops on the back and side of the pouch, makes it possible to fit and slide the pouch along any size strap, rope or chain.

3 Claims, 8 Drawing Sheets

FIG. 2.A.
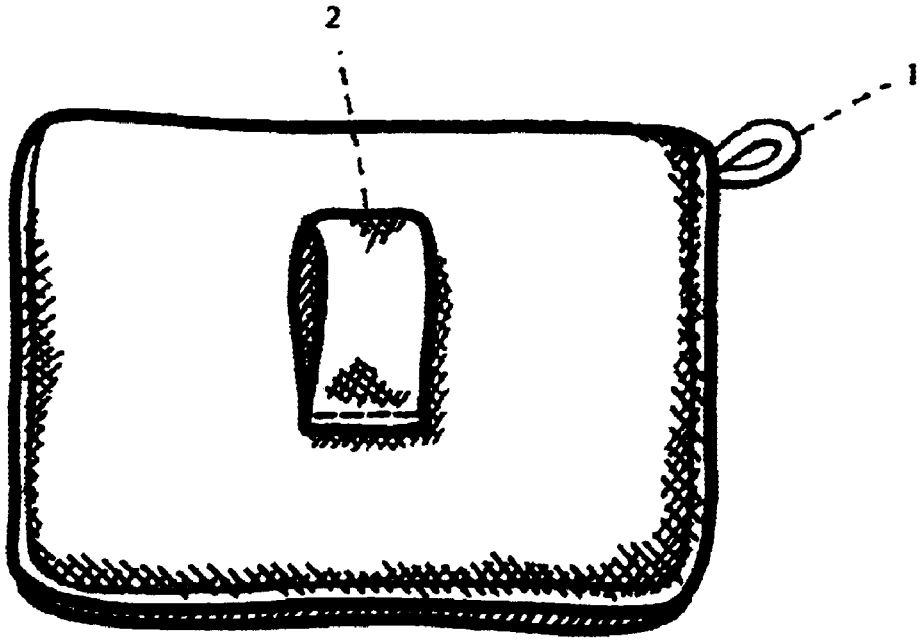

FIG. 2.B.
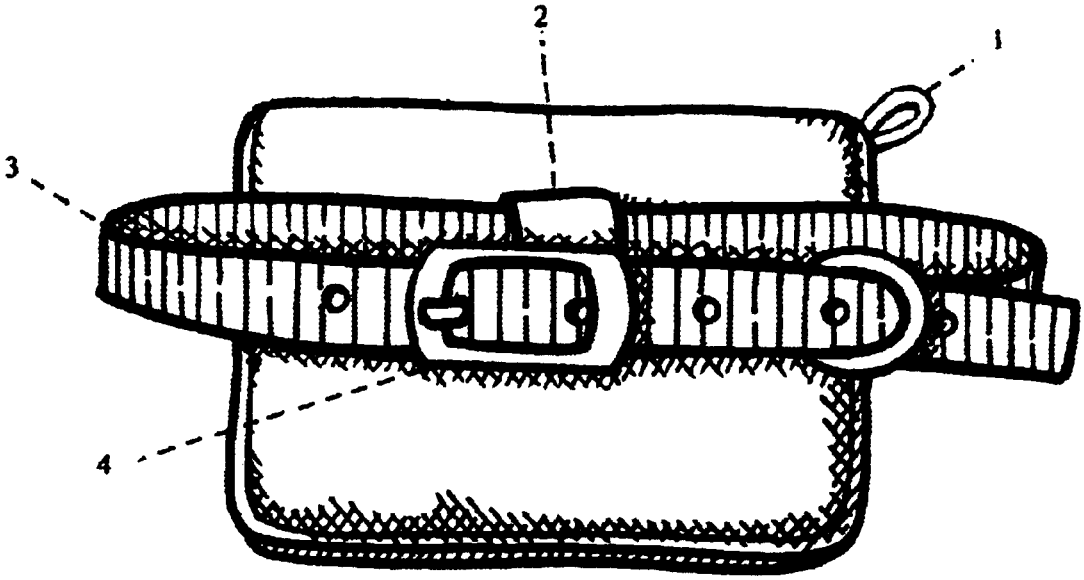

SHOE THING

BACKGROUND OF THE INVENTION

This invention relates generally to apparel as a fashion accessory, particularly to an improved system for attachment to shoes, boots, ankles, other body parts or pets. Similar accessories can be found in the following patents.

| | | | |
|---|---|---|---|
| 266277 | December, 1953 | Perry | 36/136 |
| 33343357 | August, 1967 | Stults | 2/247 |
| 4254566 | March, 1981 | Haskell | 40/636 |
| 4507882 | April, 1985 | Harrell | 36/136 |
| 4536975 | August, 1985 | Harrell | 36/136 |
| 4597198 | July, 1985 | Schweitzer | 36/100 |
| 4630383 | December, 1986 | Gamm | 36/136 |
| 463859 | January, 1987 | Gamm | 36/136 |
| 5094016 | March, 1992 | DiVito | 36/136 |
| 5195783 | March, 1993 | Lavoie | 283/75 |
| D420394 | February, 2000 | Milroy | D20/28 |

This invention discloses an easy and convenient method of attaching and detaching a fashionable and functionable pouch accessory to footwear, other body parts or a pet's collar. The inventors of the pouch (known as The Shoe Thing) have discovered the need for this product for the following reasons:

1. For athletes—while exercising, jogging or playing sports, a convenient and safe place is needed to keep money, keys, identification, etc. Pockets are not always available or safe.
2. For children—a fun, convenient and safe place is needed to carry lunch money, house keys and identification.
3. For fashion conscious individuals—when use of pockets or carrying a purse are not options, as noted in 1. and 2. above, The Shoe Thing coordinates and adds to any outfit.
4. For pets—when more than just an identification tag is needed, the pouch provides a safe place to keep other items as well as identification.

BRIEF SUMMARY OF INVENTION

The Shoe Thing is a small pouch accessory with an identification pocket that is visible only when in the open position. The pouch easily attaches and detaches to shoelaces, shoes, boots, any other form of footwear or any other body part, including: ankle, leg, wrist, arm or neck, or a pet's collar with or without a separate adjustable strap, band, rope or chain made of nylon, leather, plastic, cotton, metal, any other suitable material or any combination of the above materials. The loop located on the back and side is made of adjustable elastic to fit and slide freely along any size strap. The strap is also adjustable by means of a buckle, clip, hook and loop closure, snap, hook or any other suitable means of closure to fit on any size appendage. A shoelace or adjustable strap fits through a loop, hole or opening of any kind at the top, bottom, front, side, corner or center of The Shoe Thing. The pouch comes in a variety of shapes. These shapes are rectangular, square, round, triangle, heart, butterfly, dog, cat, star, flower, car, football, etc. or any other suitable shape. The pouch comes in a variety of colors, patterns, textures and designs or a combination thereof. The fabric or material is printed, embossed, embroidered, appliqued, painted, photo transferred or decorated and ornamented in any other way. The pouch is made of a variety of materials, including: cotton, cotton blends, nylon, plastic, paper, leather, suede, fur, imitation leather, imitation suede, imitation fur, any other suitable material or any combination of the above materials. The pouch opens and closes with a zipper, snap, hook and loop closure or any other suitable form of closure. The pattern may vary in size and shape, but generally consists one piece of material for the outside, three pieces of material for the inside to form pockets, a zipper, hook and loop closure and two elastic loops. The pouch holds identification, keys, money, medical or special instructions and other small items. This invention is not to be construed as limited to the particular forms disclosed herein, since these are to be regarded as illustrative rather than restrictive. It is therefore to be understood that the invention may be practiced within the scope of the claims and detailed descriptions otherwise than as specifically described. The above and other objects and advantages of the invention will become more readily apparent on examination of the following description, including the drawings in which like reference numerals refer to like parts.

BRIEF DESCRIPTION OF THE DRAWINGS

FIG. 2.A. is a perspective back view of The Shoe Thing in the closed position with an elastic loop in the center, which is used to insert a separate strap of different cross sections or other form of attachment, and being another optional means of attachment as mentioned above;

FIG. 2.B. is a perspective back view of The Shoe Thing in the closed position with the optional adjustable strap inserted through the loop and ready to attach to a shoe, boot ankle, any other body part or pet.

DETAILED DESCRIPTION OF THE INVENTION

Figure 1:
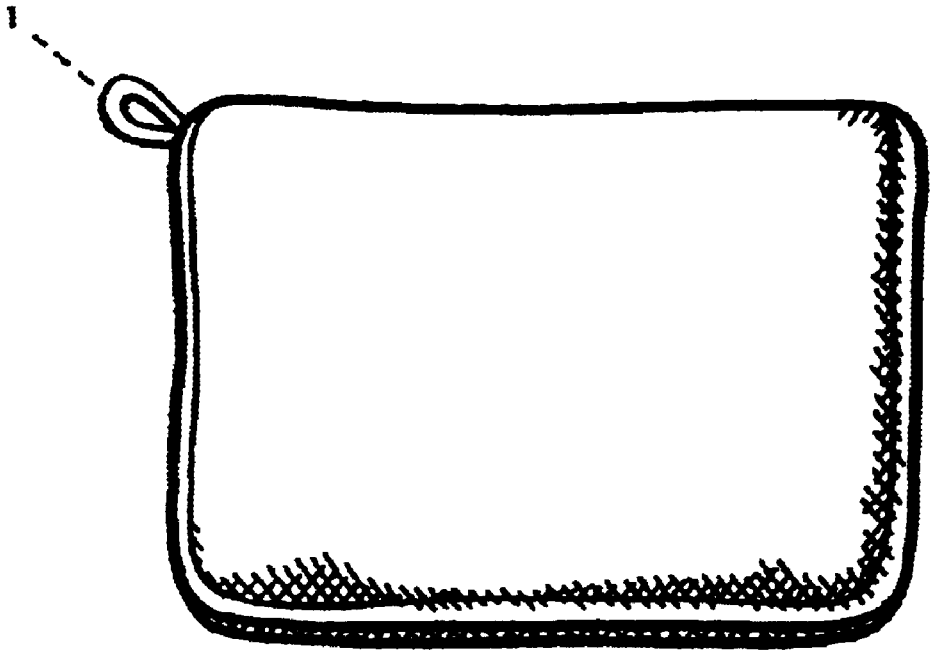
FIG. 1. is a perspective frontal view of The Shoe Thing in the closed position with a small loop in the upper left-hand corner, being one means of several means of attachment, for the option of use with a chain or cord to be worn around the neck.

Element (1), as depicted in FIG. 1., shows a side loop, which can be used to attach a chain or cord and worn around the neck.

Element (2), as depicted in FIG. 2.A., shows an elastic center loop on the back of the pouch to insert a shoelace or a separate optional strap to be worn around an appendage or object.

Element (3), in FIG. 2.B., shows a strap through the loop which is element (2).

Element (4), in FIG. 2.B., shows a buckle to adjust the size of the strap.

Figure 3:
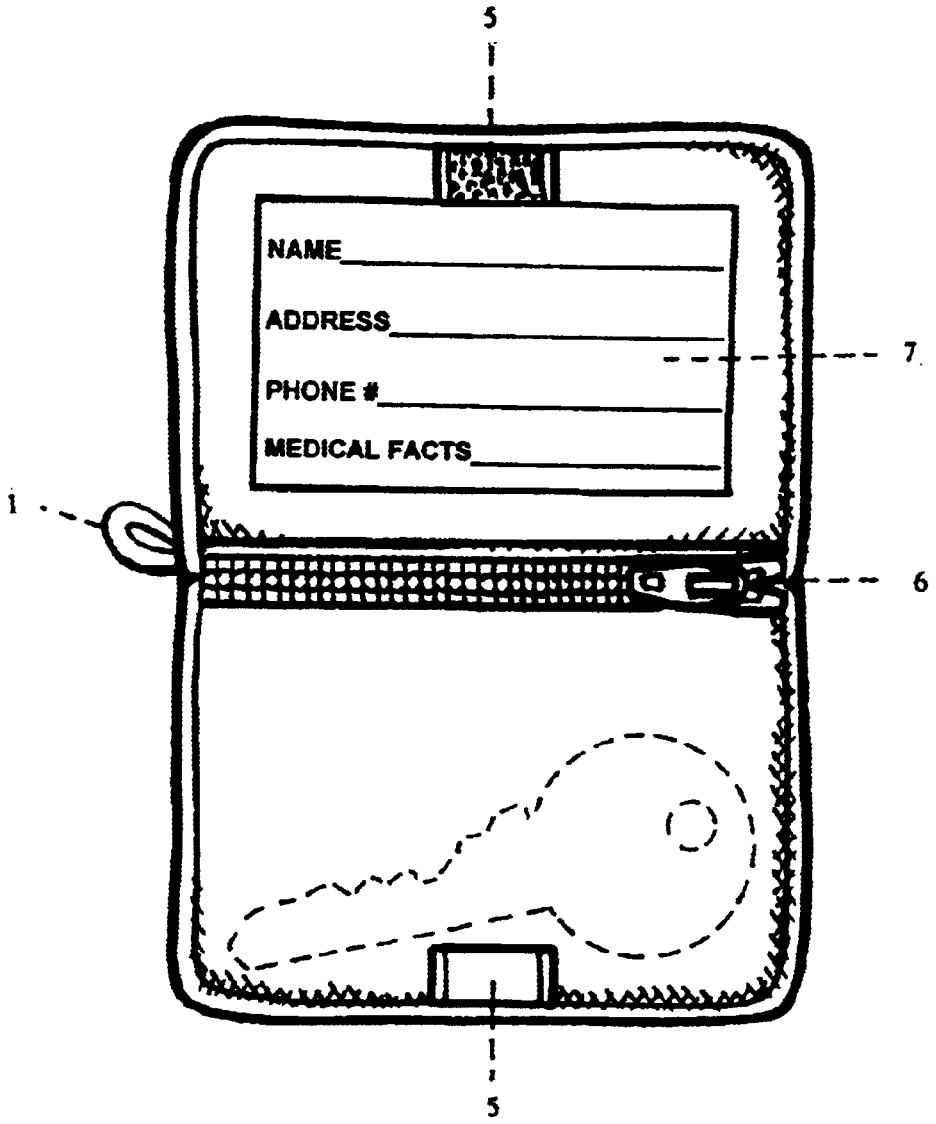
FIG. 3. is a perspective view of The Shoe Thing in the open position with a hook and loop closure located at the center of the top and bottom of The Shoe Thing (a snap, button or other form of closure could be used); a clear pocketed window is located at the top portion of the Shoe Thing and depicts identification; a zipper runs from left to right across the center and makes for secure and easy access to both top and bottom pockets of the pouch.
Figure 4:
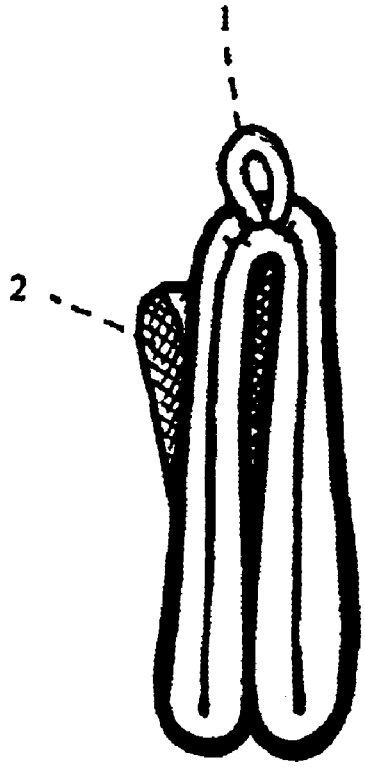
FIG. 4. is a perspective left side view of The Shoe Thing in the closed position (the back is to the left and the front is to the right)
Figure 5:
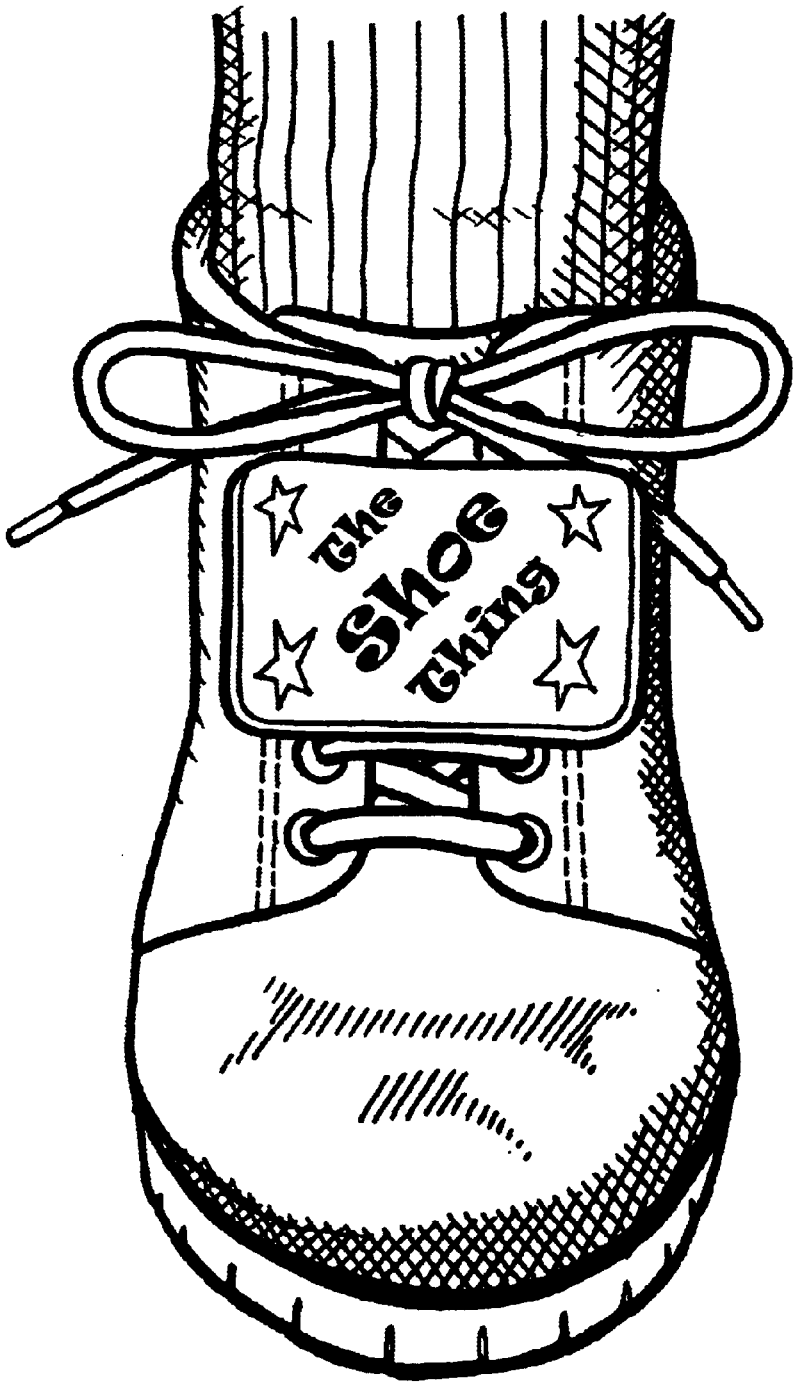
FIG. 5. depicts the invention in use on a shoelace.
Figure 6:
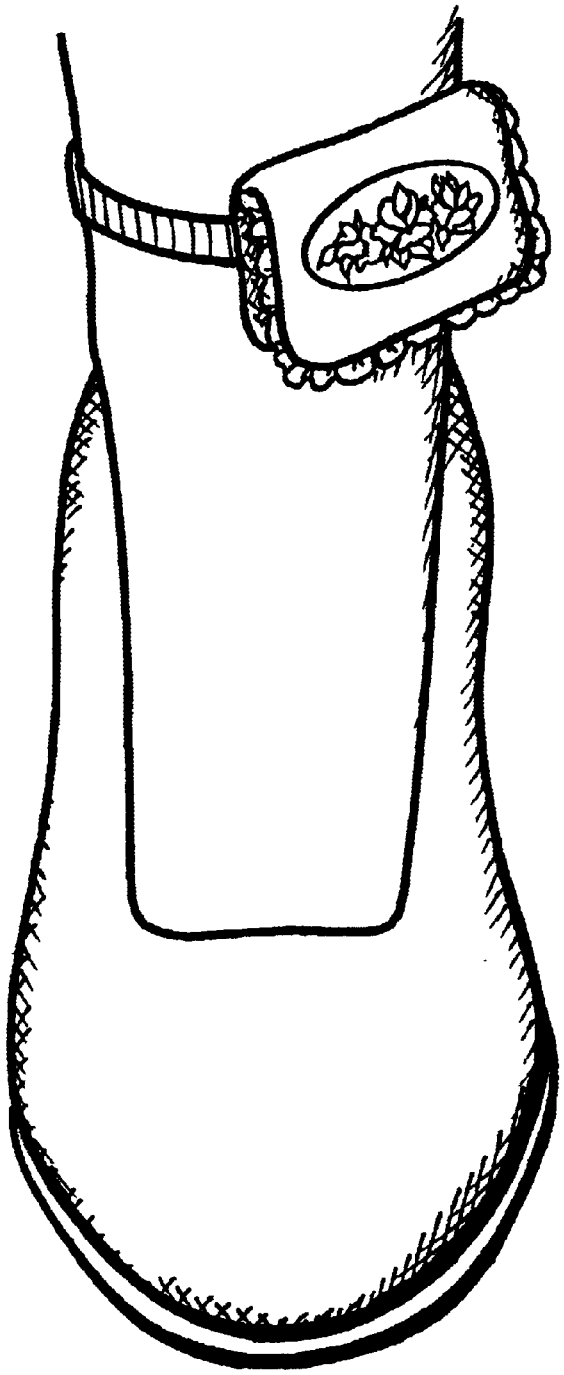
FIG. 6. depicts the invention in use on an ankle using an optional adjustable strap and FIG. 7. depicts the invention in use using an optional neck chain.
Figure 7:
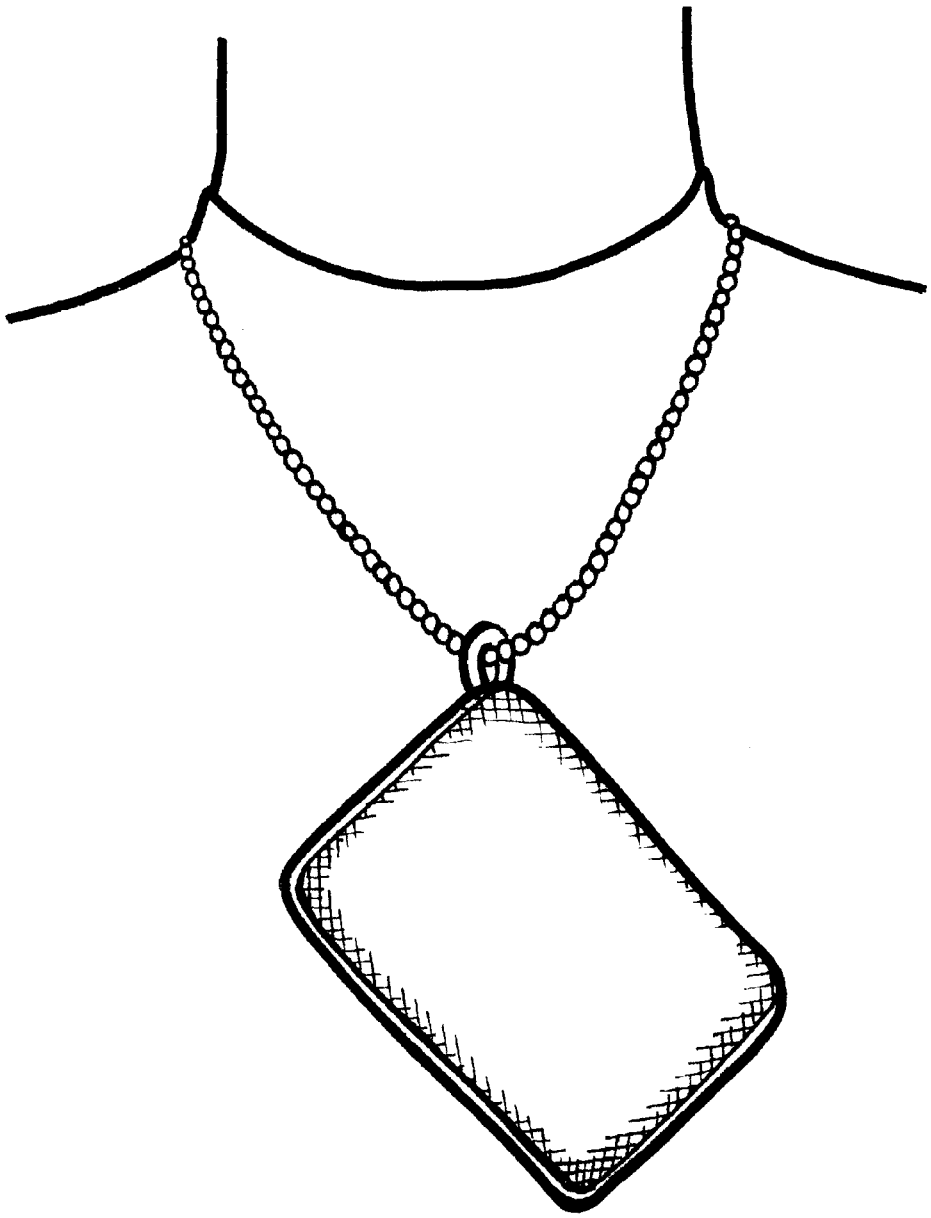

Element (5), in FIG. 3., shows a hook and loop closure to secure the pouch when in the closed position.

Element (6), in FIG. 3., shows a zipper that easily opens and closes to secure items in the two main compartments of the pouch.

Element (7), in FIG. 3., shows identification in a clear-windowed separate top pocket.

What is claimed is:

1. A small pouch comprising; a body, which folds in the center to form two equal halves, a means for releasably retaining the body in a folded position, a clear-windowed pocket with an identification card inside, the clear windowed pocket located in one of the equal halves such that the identification card is only visible when the body is in an unfolded position, two equal sized storage pockets, one of the two storage pockets located on one of the equal halves and the other of two storage pockets located on the other equal halve, each of the two storage pockets having means for releasably retaining items therein, each of the two storage pockets accessible only when the body is in the unfolded position, two loops, each having a passage and located on the body and accessible when the body is in the folded and unfolded positions, wherein one loop passage is substantially smaller than the other loop passage and a single separate attachment strap slideably mounted to either one of the loops, wherein the two loops are made of elastic material which allows for easy attachability, detachability and different cross sections of the attachment strap.

2. A small pouch, as in claim 1, wherein one of the two loops is located on a side of the body adjacent the two storage pockets when the body is in either the folded or unfolded position and the other loop is located on the opposite side of the body from the storage pockets when the body is in the unfolded position.

3. A small pouch comprising; a body, which folds in the center to form two equal halves, a means for releasably retaining the body in a folded position, a clear-windowed pocket with an identification card inside, the clear-windowed pocket located in one of the equal halves such that the identification card is only visible when the body is in an unfolded position, two equal sized storage pockets, one of the two storage pockets located on one of the equal halves and the other of the two storage pockets located on the other equal halve, each of the two storage pockets having means for releasably retaining items therein, each of the two storage pockets accessible only when the body is in the unfolded position, two elastic loops each having a passage and located on the body and accessible when the body is in the folded and unfolded positions, wherein one loop passage is substantially smaller than the other loop passage and a single separate attachment strap slideably mounted to either one of the loops, wherein the separate slideable attachment strap allows the user the option of wearing the pouch on one of a shoe lace, around a boot, on an ankle, on a body part, item or pet, and wherein the strap opens and closes by having one of a buckle, hook and loop closure, or snap.

* * * * *